US012290167B2

(12) United States Patent
Schön

(10) Patent No.: US 12,290,167 B2
(45) Date of Patent: May 6, 2025

(54) ANTI-TIPPING STORAGE FURNITURE

(71) Applicant: Inter IKEA Systems B.V., LN Delft (NL)

(72) Inventor: Daniel Schön, Kalvsvik (SE)

(73) Assignee: Inter IKEA Systems B.V., LN Delft (NL)

( * ) Notice: Subject to any disclaimer, the term of this patent is extended or adjusted under 35 U.S.C. 154(b) by 123 days.

(21) Appl. No.: 18/126,133

(22) Filed: Mar. 24, 2023

(65) Prior Publication Data

US 2024/0315442 A1 Sep. 26, 2024

(51) Int. Cl.
*A47B 67/04* (2006.01)

(52) U.S. Cl.
CPC ..... *A47B 67/04* (2013.01)

(58) Field of Classification Search
CPC ..... A47B 67/04
See application file for complete search history.

(56) References Cited

U.S. PATENT DOCUMENTS 3,186,784 A * 6/1965 Bergstein ..... A47D 11/00 312/316
3,606,506 A * 9/1971 Ungaro ..... A47B 87/00 D6/671.1
3,653,734 A * 4/1972 Ungaro ..... A47B 88/906 206/509
3,841,727 A * 10/1974 Peng ..... A47B 87/0284 190/7
5,137,340 A * 8/1992 Cugley ..... A47B 87/02 312/234.5
D417,797 S * 12/1999 Zaidman ..... D6/718.14
8,662,014 B1 * 3/2014 Harrell ..... A01K 1/0353 119/28.5
10,813,456 B1 * 10/2020 Stravitz ..... A47B 91/12
11,684,157 B1 * 6/2023 Stravitz ..... A47B 97/00 312/351.1
2007/0214567 A1 * 9/2007 Wandel ..... A47B 83/04 5/2.1
2013/0134850 A1 * 5/2013 Berkowitz ..... A47B 67/04 312/334.7

(Continued)

FOREIGN PATENT DOCUMENTS

BR 102015031758 A2 * 7/2016 ..... A47B 46/005
BR 202019007380 U2 * 10/2020 ..... A47B 67/04

(Continued)

OTHER PUBLICATIONS

Form PCT/ISA/SO6 dated Jun. 25, 2024 for corresponding International Patent Application No. PCT/EP2024/057620 (11 pages).

*Primary Examiner* — Hanh V Tran
(74) *Attorney, Agent, or Firm* — Merchant & Gould P.C.

(57) ABSTRACT

A storage furniture is disclosed. The storage furniture includes a frame and at least one drawer movable into and at least partly out of the frame when the at least one drawer present in the frame. The frame includes an upper section and a lower section, the lower section having a greater front to back distance than that of the upper section. The upper section includes a pair of upper side panels and the lower section includes a pair of lower side panels. The pair of upper side panels are detachably connected to the pair of lower side panels when the frame is in an installed state.

19 Claims, 3 Drawing Sheets

(56) References Cited

U.S. PATENT DOCUMENTS

| | | | | | |
|---|---|---|---|---|---|
| 2017/0172297 | A1* | 6/2017 | Monteiro | ..... | A47B 67/04 |

FOREIGN PATENT DOCUMENTS

| | | | | | |
|---|---|---|---|---|---|
| CA | 971704 | A | | 7/1975 | |
| CA | 2689817 | A1 | * | 7/2010 | ..... A47B 57/20 |
| CN | 115104859 | A | * | 9/2022 | |
| CN | 115381226 | A | * | 11/2022 | ..... A47B 67/04 |
| DE | 202011003651 | U1 | * | 7/2011 | ..... A47B 67/04 |
| EP | 728429 | A1 | * | 8/1996 | ..... A47B 88/00 |
| KR | 200175851 | Y1 | * | 3/2000 | |
| KR | 20110000804 | U | * | 1/2011 | |
| KR | 20110107893 | A | * | 10/2011 | |
| KR | 101249588 | B1 | * | 4/2013 | |
| KR | 20140001720 | U | * | 3/2014 | |
| KR | 20170062871 | A | * | 6/2017 | |
| KR | 101866934 | B1 | * | 6/2018 | |
| KR | 102392408 | B1 | * | 5/2022 | |

* cited by examiner

ANTI-TIPPING STORAGE FURNITURE

TECHNICAL FIELD

The present disclosure generally relates to a storage furniture, and more particularly to a storage furniture with anti-tipping characteristics and/or anti-tipping mechanisms that help prevent the storage furniture from tipping over.

BACKGROUND

Storage furniture has existed for a long time and includes, e.g., a chest of drawers, dressers, armoires, nightstands, accent chests, office furniture, dining furniture, and shelving units. Typical storage furniture includes a fixed rectangular frame structure in the form of a cabinet, and several drawers which may be individually drawn out from the cabinet in a horizontal direction. In such a structure, however, the center of gravity is high and tilt may occur due to climbs by children, opening of the drawers, or over-load at the upper drawers. This may cause instability in the furniture and hazards to safety of the users. Furniture tipping accidents have been on the rise.

Therefore, where a storage furniture exceeds a specific height, the concern of tip-over prevention needs to be considered. For example, the U.S. Consumer Product Safety Commission (CPSC) established a new mandatory furniture tip-over standard expected to go into effect in May of 2023 that requires any storage furniture that is 27 inches (about 68 cm) or more in height to meet certain stability requirements. The rule involves two test methods to determine product stability, both of which include placing units on a forward angle of 1.5 degrees to simulate the effect that carpeting has on stability. The testing is also conducted with all drawers open and containing 8.5 pounds (about 3.85 kg) of weight per cubic foot to simulate drawers filled with clothing. Then, weight is applied to the uppermost extended drawer until the unit begins to tip to calculate the unit's "tip-over moment", which is used in another calculation to determine whether the unit is sufficiently stable to withstand tipping over when a child is climbing or playing on the unit. Storage furniture released into the market going forward must meet these new standards.

In view of the problem mentioned, there is a need for an improved storage furniture with enhanced stability and reduced risk of tip-over accidents.

According to the present disclosure, there is provided an anti-tipping storage furniture, as set forth in the appended claims.

SUMMARY

An object of the disclosure is to provide a storage furniture with improved stability and reduced risk of tip-over accidents, so as to resist tipping when a top drawer of the storage furniture is open.

Another object of the disclosure is to provide a storage furniture that allows for a cost-effective structure and manufacturing, while allowing for easy transportation and installation.

According to a first aspect, there is provided a storage furniture with a frame including a front side, a back side, an upper section with an upper front region, a lower section with a lower front region, and a central longitudinal axis equally spaced from outermost extents of the front side and the back side. The lower front region of the lower section being more forward from the central longitudinal axis of the frame than the upper front region of the upper section. A lower drawer is movable into and at least partly out of the lower section of the frame. The lower drawer includes a plurality of support structures extending downwards from a bottom of the lower drawer for supporting the lower drawer on a floor surface when in an installed state.

The provision of the lower front region of the lower section being more forward from the central longitudinal axis of the frame than the upper front region of the upper section lowers the center of gravity of the storage furniture, thereby increasing stability. According to an example, the lower section has a greater front to back distance than that of the upper section.

The provision of the lower drawing including a plurality of support structures configured to supporting the lower drawer on the floor surface reduces or offsets any downward pulling force by the lower drawer on the frame, to provide a mechanism that resists tip-over. For example, the lower drawer is movable into and at least partly out of the lower section of the frame without exerting a downward pressure on the frame when in the installed state.

Pursuant to an implementation, the plurality of support structures comprise wheels configured to roll on the floor surface.

Additionally or alternatively, the upper section is detachably connected to the lower section in the installed state along a connection interface. The separable (detachably connected) lower and upper sections helps facilitate transportation and warehousing of the storage furniture since the storage furniture can be disassembled into smaller pieces. Further, the separable (detachably connected) lower and upper sections may save on material costs since the upper section, with for example a lesser front to back distance than the lower section, may be manufactured from a different piece of material than the lower section and thus avoid trimming down a larger piece of material that generates waste material.

Pursuant to an implementation, the lower section includes a lower panel and the upper section includes an upper panel, the lower panel arranged between the lower drawer and the upper section relative to the central longitudinal axis. The lower panel has a front surface more forward from the central longitudinal axis than a front surface of the upper panel.

The lower section may further include two lower side panels interconnected by the lower panel, the two lower side panels each having a respective bottom surface for resting on the floor surface. The two lower side panels together with the lower panel may at least partially define a compartment for the lower drawer.

Additionally or alternatively, the two lower side panels each have a respective top surface and a respective interior surface, and the lower panel is arranged at a distance from the respective top surface of each of the two lower side panels relative to the central longitudinal axis. A guide track or sliding rail is arranged on the respective interior surface of the two lower side panels between the respective top surface and the lower panel for receiving an upper drawer of the upper section.

The upper drawer has a front panel with a forwardmost surface that is inwards of the front surface of the lower panel relative to the central longitudinal axis when the upper drawer is in a closed position.

The upper section may further include two upper side panels interconnected by the upper panel, the two upper side panels each having a respective front facing surface. The front surface of the lower panel may be more forward from the central longitudinal axis than the respective front facing surface of the two upper side panels.

The two upper side panels each have a respective bottom surface facing the lower section and a top surface, and the two lower side panels each having a respective bottom surface and a top surface facing the upper section. According to an implementation, the respective bottom surfaces of the two upper side panels have at least one fastener and the respective top surfaces of the two lower side panels have at least one counter fastener, wherein the at least one fastener is structured and arranged to engage with the at least one counter fastener to secure the upper section to the lower section. For example, the respective bottom surfaces of the two upper side panels may each comprise one or more pins that engage into a corresponding hole in the respective top surfaces of the two lower side panels. As another example, the respective bottom surfaces of the two upper side panels and the respective top surfaces of the two lower side panels may each comprise one or more holes that receive a corresponding pin. In either case, the bottom surfaces of the two upper side panels mate with the top surfaces of the two lower side panels to define the connection interface.

According to a second aspect of the disclosure, there is provide a storage furniture including a frame and at least one drawer movable into and at least partly out of the frame when the at least one drawer present in the frame. The frame includes an upper section and a lower section, the lower section having a greater front to back distance than that of the upper section. The upper section includes a pair of upper side panels (e.g., left and right upper lateral side panels) and the lower section includes a pair of lower side panels (e.g., left and right lower lateral side panels). The pair of upper side panels are detachably connected to the pair of lower side panels when the frame is in an installed state. The separable (detachably connected) lower and upper sections facilitates improvements with respect to transportation, manufacturing, and cost savings as explained above.

Pursuant to an implementation, the pair of lower side panels each have a respective bottom surface and a respective top surface, the lower section further including a lower panel interconnecting the pair of lower side panels, the lower panel disposed at a greater distance from the respective bottom surface of the pair of lower side panels than the respective top surface of the pair of lower side panels to at least partially define a compartment underneath the lower panel relative to the upper section.

The at least one drawer is movable into and at least partly out of the compartment in the lower section of the frame, and wherein the at least one drawer includes a plurality of wheels on a bottom of the at least one drawer that roll on a floor surface and support the at least one drawer when in the installed state. In this case, the at least one drawer may be a lowermost drawer of the storage furniture.

The at least one drawer (e.g., the lowermost drawer) is movable into and at least partly out of the compartment in the lower section without exerting a downward pressure on the frame. For example, the drawer may be dimensioned to fit into the compartment without the provision of a guide track, sliding system or other connecting mechanism. Alternatively, if a guide track or connecting mechanism is provided, the lower drawer may include a mating sliding member that is arranged with sufficient axial play (relative to the central longitudinal axis) in the guide track, e.g., via the configuration of the support structures (e.g., wheels), that the drawer does not exert a downward pressure on the frame when in an opened or pulled out state. In either case, the lower drawer supports itself on the floor surface via the support structures (e.g., wheels), and thus does not influence or only minimally influences the stability of the storage furniture when drawn out from its closed position.

Pursuant to an implementation, the pair of lower side panels each have a respective inner surface and the lower panel has a front surface, and the lower section includes a horizontal guide track disposed on the inner surface between the lower panel and the respective top surface. The at least one drawer (e.g., an upper drawer) includes corresponding guide tracks or a sliding member (e.g., an outward protrusion of wheel) that respectively mate with the horizontal guide track on the pair of lower side panels. The (upper) drawer has a front panel with a forwardmost surface that is inwards of the front surface of the lower panel relative to a central longitudinal axis of the frame when the at least one drawer is in a closed position.

The pair of upper side panels may each have a respective bottom surface that ends at a greater vertical distance from the lower panel than a bottom of the at least one drawer, so that the pair of upper side panels and the pair of lower side panels each partly cover the lateral sides of the at least one drawer.

Pursuant to an implantation, the pair of lower side panels each have a respective top surface facing the upper section, and the pair of upper side panels each have a respective bottom surface facing the lower section. The respective top surfaces of the pair of lower side panels and the respective bottom surfaces of the pair of upper side panels may have fasteners (e.g., pin(s) and/or hole(s) for releasably securing the upper section to the lower section along a connection interface.

The pair of lower side panels each have a respective bottom surface for resting on a floor surface and supporting the frame, and wherein the respective top surface of the pair of lower side panels defines a front to back distance that is less than that of the respective bottom surface of the pair of lower side panels. The respective bottom surfaces of the pair of lower side panels may rest on the floor surface directly and define a lowermost surface of the storage furniture, or indirectly via legs (e.g., front and rear legs) extending downwards from the bottom surfaces of the lower side panels.

Additionally or alternatively, the pair of lower side panels each have a front facing part including a first straight and elongate portion adjoining the respective bottom surface and extending vertically relative to the floor surface, and a second portion that extends from the first portion to the respective top surface of the pair of lower side panels. The second portion may be straight and angled relative to the first straight and elongate portion, or the second portion may be curved from the first portion to the respective top surface.

Other objectives, features and advantages of the present disclosure will appear from the following detailed disclosure, from the attached claims as well as from the drawings. Implementations of the disclosure may include combinations of the above-described features.

BRIEF DESCRIPTION OF THE DRAWINGS

While the claims are not limited to a specific illustration, an appreciation of various aspects may be gained through a discussion of various examples. The drawings are not necessarily to scale, and certain features may be exaggerated or hidden to better illustrate and explain an innovative aspect of an example. Further, the exemplary illustrations described herein are not exhaustive or otherwise limiting, and are not restricted to the precise form and configuration shown in the drawings or disclosed in the following detailed description. Exemplary illustrations are described in detail by referring to the drawings as follows:

DETAILED DESCRIPTION

Figure 1A:
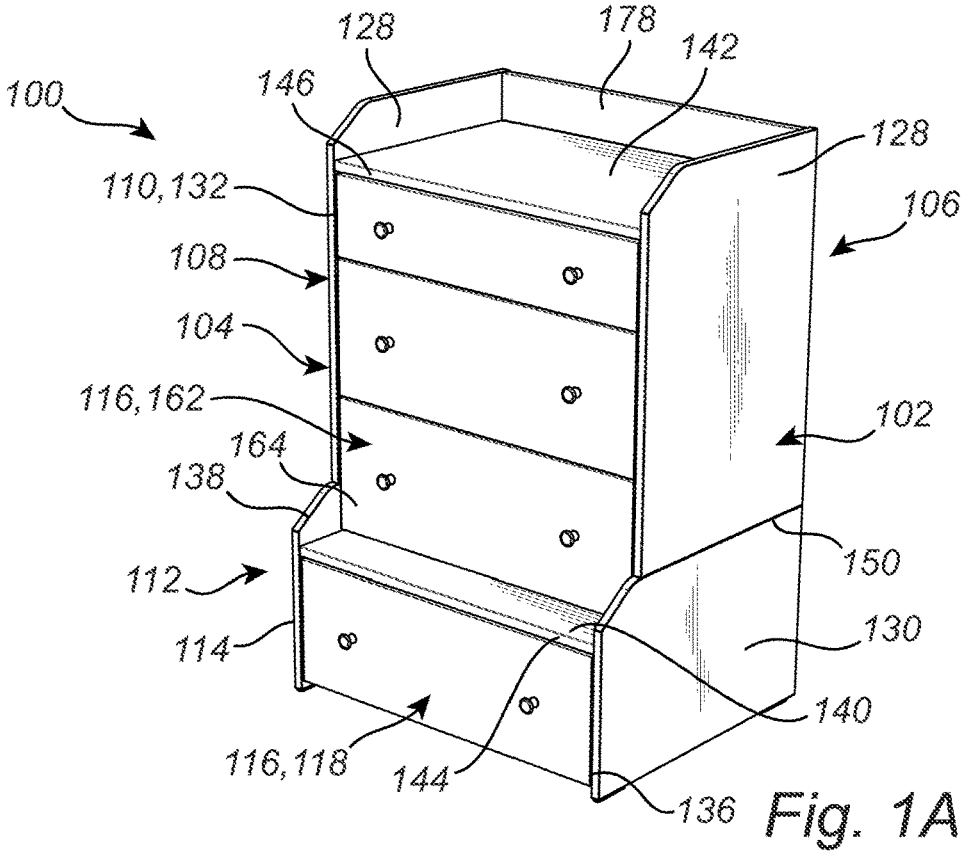
FIG. 1A is a perspective view of a storage furniture in an installed state.

In the drawings, where like numerals and characters indicate like or corresponding parts throughout the several views, exemplary illustrates are shown in detail. The various features of the exemplary approaches illustrated and described with reference to any one of the figures may be combined with features illustrated in one or more other figures, as it will be understood that alternative illustrations that may not be explicitly illustrated or described may be able to be produced. The combinations of features illustrated provide representative approaches for typical applications. However, various combinations and modifications of the features consistent with the teachings of the present disclosure may be desired for particular applications or implementations.

Figure 1B:
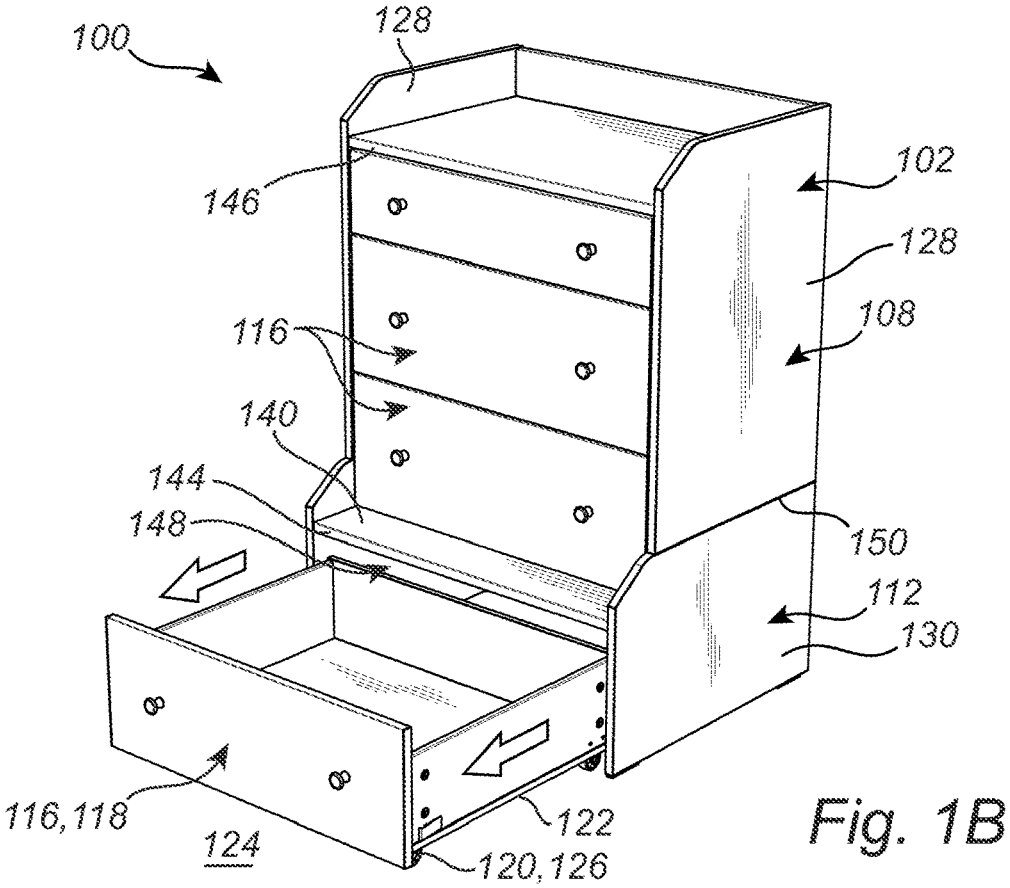
FIG. 1B is a perspective view of the storage furniture of FIG. 1A with the lower drawer pulled/drawn out from its closed position.

With reference to the drawings, FIGS. 1A-1B show a storage furniture 100 according to an example. The storage furniture 100 includes a frame 102 including a front side 104, a back side 106, an upper section 108 with an upper front region 110, a lower section 112 with a lower front region 114, and one or more drawers 116 movable into and at least partly out of the frame 102. The drawer(s) 116 in the upper section 108 include a sliding system or other hardware to connect the drawer(s) 116 to the frame 102. As such, when the drawer(s) 116 in the upper section 108 is/are drawn out from its closed position, the drawer(s) 116 will exert a downward force on the frame 102. The storage furniture 100 additionally includes a lower or lowermost drawer 118 movable into and at least partly out of the lower section 112 of the frame 102. The lower drawer 118 may have a greater depth (e.g., front to back distance) than the drawers 116 in the upper section 108. FIG. 1A shows the lower drawer 118 in its closed position, and FIG. 1B shows the lower drawer 118 in a drawn-out position.

Figure 3:
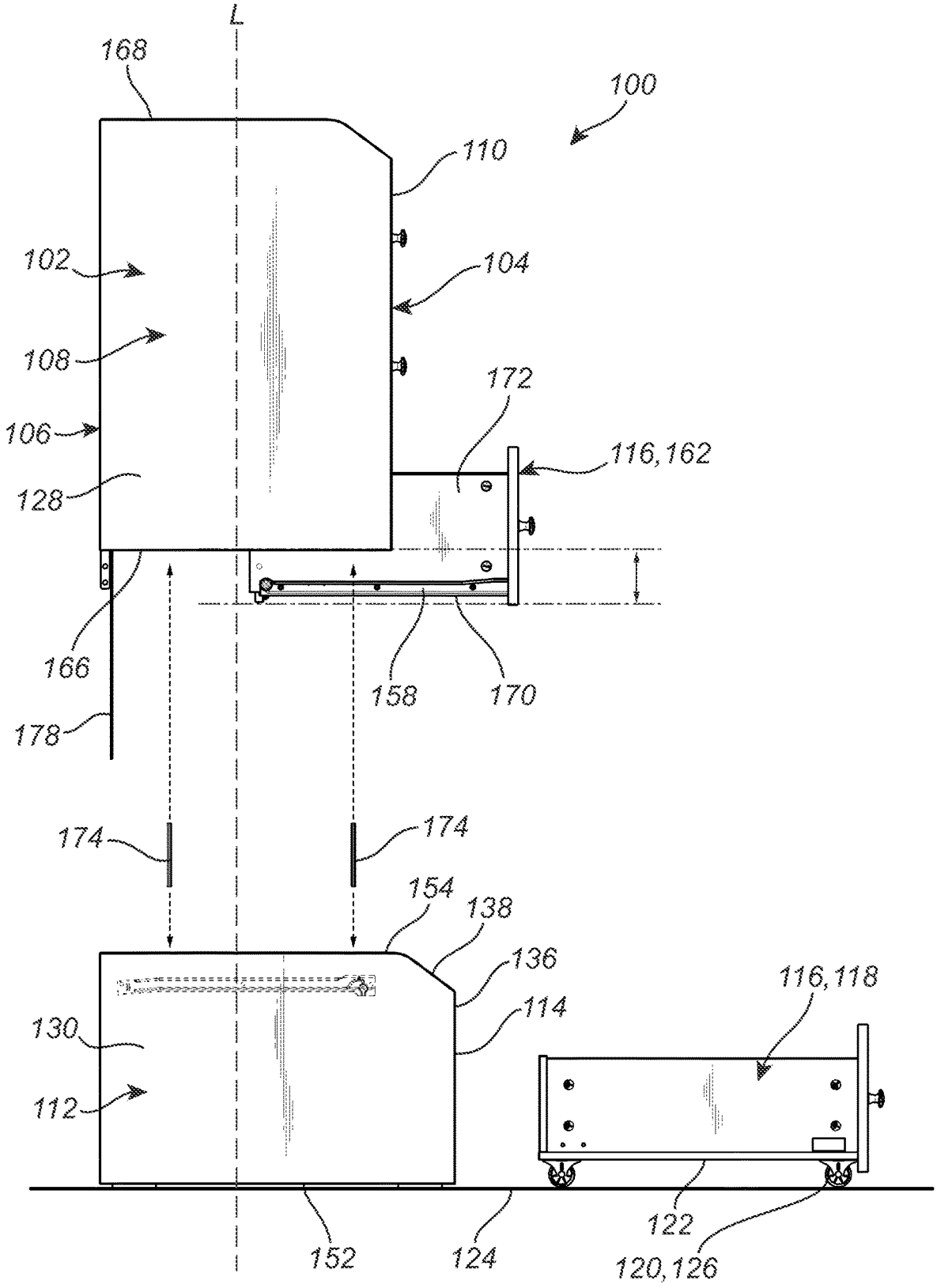
FIG. 3 is a side view of the storage furniture of FIG. 2.

As shown in FIGS. 1B and 3, the lower drawer 118 includes a plurality of support structures 120 extending downwards from a bottom 122 of the lower drawer 118 for supporting the lower drawer on a floor surface 124 when in an installed/assembled state of the storage furniture 100. The support structures 120 may comprise wheels 126 (e.g., casters) configured to roll on the floor surface 124. By providing support structures 120 such as wheels 126 on the bottom 122 of the lower drawer 118, the lower drawer 118 may be drawn out from its closed position without exerting a downward force on the frame 102, thereby imparting increased stability and anti-tipping characteristics to the frame 102 and storage furniture 100. In the illustrated example, the lower drawer 118 is disconnected from the frame 102 (e.g., without a sliding system or other hardware connecting the lower drawer 118 to the lower section 112), and thus does not influence the stability of the storage furniture 100 when in the drawn-out position (shown in FIG. 1B). Alternatively, the lower drawer 118 may be connected to the frame 102 via a sliding system that facilitates guiding the lower drawer 118 into and out of the lower section 112 and/or stops the lower drawer 118 at a predetermined drawn-out position from the frame 102. In this case, the support structures 120 (e.g., wheels 126) still bear the weight of the lower drawer 118 including any contents therein, so that the lower drawer 118 will only minimally (if at all) exert a downward force on the frame 102 when the lower drawer 118 is drawn out from its closed position. Further, if the lower drawer 118 is slidably connected to the frame 102, the lower drawer 118 may act as a horizontal extension that resists forward tipping or rotation in the drawn-out position to enhance stability of the storage furniture 100. The lower drawer 118 thereby provides anti-tipping characteristics to the storage furniture 100 through the provision of support structures 120 (e.g., wheels) that support the lower drawer 118 on the floor surface 124, regardless of whether the lower drawer 118 is connected or disconnected from the frame 102.

Referring to FIGS. 1A and 3, the lower front region 114 of the lower section 112 is disposed more forward from a central longitudinal axis L (see FIG. 3) of the frame 102 than the upper front region 110 of the upper section 108. That is, a frontmost edge or surface of the lower section 112 is disposed more forward than a frontmost edge or surface of the upper section 108. The upper front region 110 and the back side 106 define a front to back distance of the upper section 108 extending transversely (e.g., perpendicular) to the central longitudinal axis L, and the lower front region 114 and the back side 106 define a front to back distance of the lower section 112 extending transversely (e.g., perpendicular) to the central longitudinal axis L. According to the illustrated example, the lower section 112 has a greater front to back distance than the upper section 108. The frame 102 thereby provides anti-tipping properties arising from its construction or shape. For example, the more forward position of the lower front region 114 of the lower section 112 relative to the upper front region 110 of the upper section 108 requires more force or weight to tip the storage furniture 100 forward. Further, by having the upper front region 110 further back than the lower front region 114, toddlers or children now have significantly more difficulty in grabbing the upper drawers 116 (the drawer(s) in the upper section 108). Additionally, the greater front to back distance of the lower section 112 relative to the upper section 108 lowers the center of gravity of the storage furniture 100 to be closer to the lower section 112, thereby making tipping more difficult.

The upper section 108 includes two or a pair of upper side panels 128 (e.g., upper left and right lateral side panels) and the lower section 112 includes two or a pair of lower side panels 130 (e.g., lower left and right lateral side panels). The upper side panels 128 may be generally rectangular in a vertical orientation and have a straight and elongate front facing part 132 defining a forwardmost surface of the upper section 108. The lower side panels 130 may be generally rectangular in a horizontal orientation and have a front facing part comprising a first portion 136 defining a forwardmost surface of the lower section 112 and a second portion 138 providing a transition from the first portion 136 to the front facing part 132 of the upper section 108. Thus, the first portion 136 of the lower section 112 is disposed more forward than the front facing part 132 of the upper section 108 relative to the central longitudinal axis L. The first portion 136 may extend vertically straight and elongate relative to the floor surface 124. The second portion 138 may extend straight and angled relative to the first portion 136 as shown, or the second portion 138 may have a curved shape.

The lower section 112 includes a lower horizontal panel 140 interconnecting the two lower side panels 130 that is arranged between the lower drawer 118 and the upper section 108 relative to the central longitudinal axis L. The lower panel 140 may extend from the front side 104 of lower section 112 of the frame 102 to the back side 106 of the frame 102. The upper section 108 includes an upper horizontal panel 142 interconnecting the two upper side panels 128 that is disposed at or near the top of the frame 102. The upper panel 142 may extend from the front side 104 of the upper section 108 of the frame 102 to the back side 106 of the frame 102. The lower panel 140 has a front surface 144 more forward from the central longitudinal axis than a front surface 146 of the upper panel 142. Further, the front surface 144 of the lower panel 140 may be disposed at generally the same forward position as the first portion 136, e.g., the front surface 144 and the first portion 136 may define a common forwardmost surface of the frame 102 relative to the central longitudinal axis L. Accordingly, the lower panel 140 may be arranged below the second portion 138 relative to the floor surface 124. The lower panel 140 together with the two lower side panels 130 at least partially define a compartment 148 for the lower drawer 118. The compartment 148 accommodates the lower drawer 118 when in the closed position (shown in FIG. 1A).

The upper section 108 is defined, at least partially, by the two upper side panels 128 and the upper horizontal panel 142. The lower section 112 is defined, at least partially, by the two lower side panels 130 and the lower horizontal panel 140. The upper section 108 is detachably connected to the lower section 112 in the installed state along a connection interface 150. The connection interface 150 is formed between the two upper side panels 128 and the two lower side panels 130. The ability to disconnect and detach the upper section 108 from the lower section 112 facilitates easy storage/warehousing and transportation of the storage furniture 100 in an uninstalled or disassembled state, particularly in the case of large furniture such as a chest of drawers or file cabinets, while the connection interface 150 provides for easy assembly into the installed state. Further, manufacturing costs and material savings can be achieved since the upper side panels 128 can be cut or formed from a different piece of material (e.g., wood, plastic, composites, metal) than the lower side panels 130, such that a smaller piece in terms of front to back distance can be used for the upper side panels 128 without having to cut or machine away excess material as would be the case if the sides were formed from a unitary piece of material.

Figure 2:
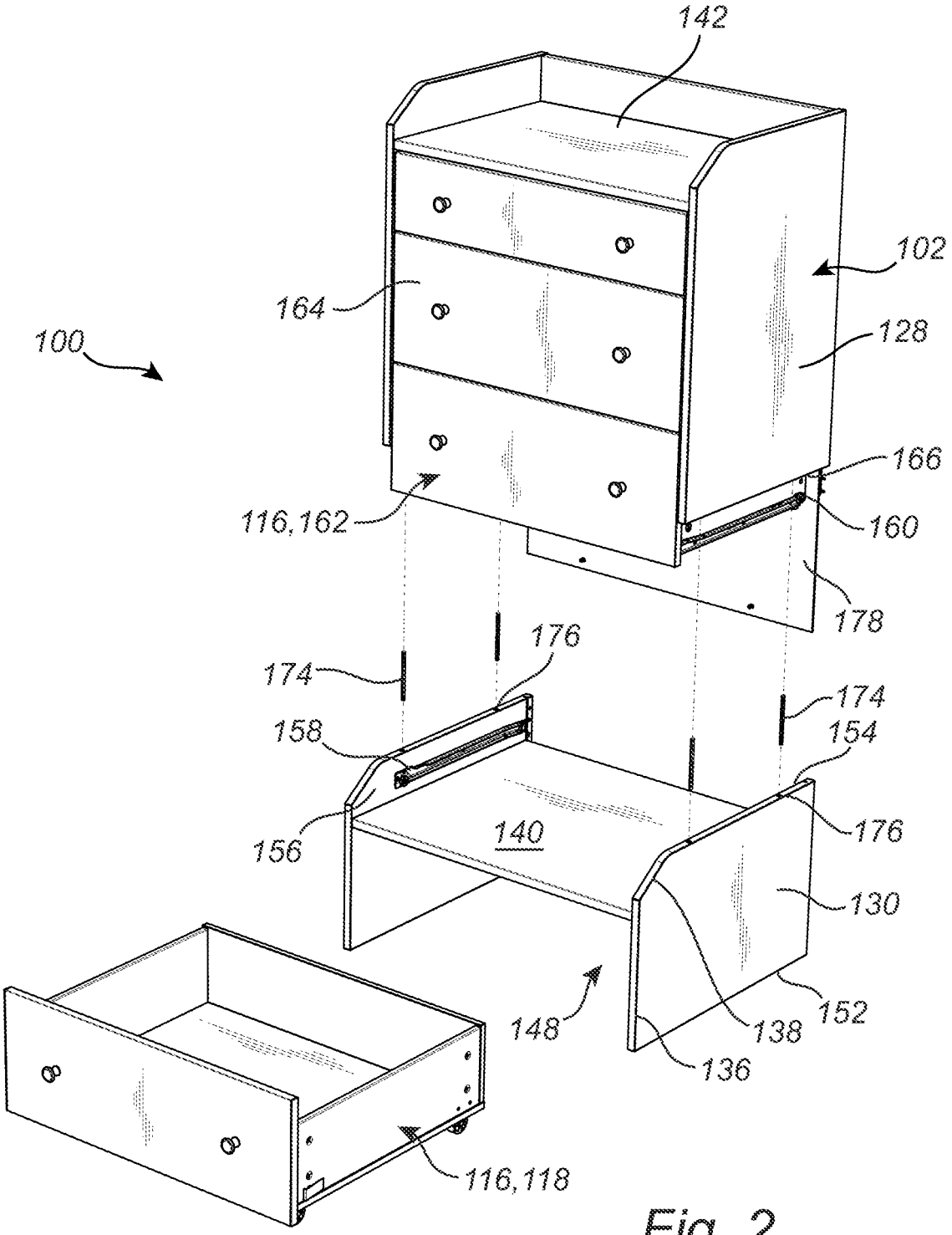
FIG. 2 is a perspective view of the storage furniture of FIG. 1A in an uninstalled state with the upper section of the frame detached from the lower section of the frame.

With reference to FIGS. 2-3, the two lower side panels 130 each have a respective bottom surface 152 and a respective top surface 154. The bottom surface 152 may rest on the floor surface 124 directly, or indirectly via downwardly extending legs. The first portion 136 adjoins the respective bottom surface 152 and the second portion 138 extends from the first portion 136 to the respective top surface 154. Accordingly, the top surface 154 may define a front to back distance that is less than the bottom surface 152.

The lower panel 140 is arranged between the bottom surface 152 and the top surface 154 along the central longitudinal axis L, and may be arranged closer to the top surface 154 than the bottom surface 152, e.g., the lower panel 140 is arranged at a greater distance from the bottom surface 152 than the top surface 154 relative to the central longitudinal axis L), so as to provide the compartment 148 underneath the lower panel 140 for the lower drawer 118. The support structures 120 or wheels 126 of the lower drawer 118 are arranged on the same general plane as the lowermost surface of the frame 102 (e.g., the bottom surface 152 or downwardly extending legs), such that the lower drawer 118 does not exert a downward force on the frame 102 when drawn out from its closed position.

On an inner surface 156 of the lower side panels 130, between the lower panel 140 and the top surface 154, a sliding system or guide track 158 is provided for receiving a mating sliding system or guide track 160 on an upper drawer 162, for guiding the upper drawer 162 into and at least partly out of the frame 102. In this case, the upper drawer 162 is the drawer 116 in the upper section 108 immediately adjacent to the lower panel 140. The guide tracks 158, 160 extend transversely to, e.g., perpendicularly or horizontally to, the central longitudinal axis L. When the upper drawer 162 is in the closed position (as shown in, e.g., FIGS. 1A and 2), its front panel 164 defines a forwardmost surface that is inwards of the front surface 144 of the lower panel relative to the central longitudinal axis L. Such an inset or inward relationship of the upper drawer 162 relative to the front surface 144 of the lower panel 140 and lower front region 114 (e.g., first portion 136) of the lower section 112 help promotes stability by rearranging (lowering) the center of gravity of the storage furniture 100 and provides a larger base in terms of front to back distance to help resist tipping when a top/upper drawer is pulled out from its closed position.

The two upper side panels 128 each have a respective bottom surface 166 facing the lower section 108 and a top surface 168. The bottom surface 166 of the upper side panels 128 ends at a greater vertical distance from the lower panel 140 than a bottom 170 of the upper drawer 162, so that the two upper side panels 128 and the two lower side panels 130 each partly cover the lateral sides 172 of the upper drawer 162.

The bottom surface 166 of the upper side panels 128 and the top surface 154 of the lower side panels 130 mate with one another to at least partially define the connection interface 150 between the upper section 108 and the lower section 112. The bottom surface 166 of the upper side panels 128 and the top surface 154 of the lower side panels 130 may have approximately the same front to back distance and may be substantially parallel, although other configurations such as stepped or flanged configurations are contemplated. According to an implementation, the respective top surfaces 154 and the respective bottom surfaces 166 each have fasteners 174, 176 for securing the upper section 108 to the lower section 112. For example, the top surfaces 154 and the bottom surfaces 166 may each have one or more holes 176 that receive corresponding pins 174 to secure the upper section 108 and the lower section 112 together. It will be appreciated that different forms of fasteners are contemplated to provide the detachable connection between the upper and lower sections 108, 112. Additionally, it will be appreciated that fasteners disposed on different surfaces are contemplated, such as one or more brackets secured to the inner surfaces of the upper and lower side panels 128, 130 along the connection interface 150.

A back panel 178 may be provided at the back side 106 of the frame 102, extending between the respective lateral sides 128, 130 of the upper and lower sections 108, 112. The back panel 178 may comprise a single piece of material extending the entire vertical height of the frame 102. Alternatively, the back panel 178 may extend partly over the vertical height of the frame 102 on the upper section 108 and/or the lower section 112. Further, the back panel 178 may comprise multiple panel supports (not shown) extending between the respective lateral sides 128, 130 only over part of the vertical height thereof. As shown in FIGS. 2-3, the back panel 178 may form the back side of the compartment 148 to provide a five-sided box structure for the lower drawer 118, together with the side panels 130 and lower panel 140 along with the floor surface 124 upon which the lower drawer 118 rolls or slides.

Accordingly, the storage furniture 100 comprises a divided frame (e.g., upper section 108 and lower section 112) that provides benefits with respect to manufacturing costs and material savings as well as facilitates transporting/moving the storage furniture 100 from, e.g., a warehouse or showroom to a customer's house or office. The connection interface 150 (e.g., mating surfaces 154, 166 of the lower 112 and upper 108 sections, respectively) facilitates easy assembly into the installed/assembled state. By providing the lower section 112 with a lower front region 114 that is more forward than an upper front region 110 of the upper section 108 relative to a central longitudinal axis L, improvements with respect to stability and anti-tipping characteristics can be achieved. The provision of support structures 120 (e.g., wheels/casters 126) on the lower drawer 118 further enhances stability by enabling the lower drawer 118 to support itself on the floor surface 124 without exerting a downward force on the frame 102 when drawn out from its closed position.

Various examples/embodiments are described herein for various articles. Although the storage furniture 102 is shown as a dresser merely as an example for which the anti-tipping mechanism(s) and divided frame structure may be integrated or incorporated, it is contemplated that other types of furniture (e.g., office cabinets, nightstands, etc.) may be used without departing from the scope of the disclosure. Numerous specific details are set forth to provide a thorough understanding of the overall structure, function, manufacture, and use of the examples/embodiments as described in the specification and illustrated in the accompanying drawings. It will be understood by those skilled in the art, however, that the examples/embodiments may be practiced without such specific details. In other instances, well-known operations, components, and elements have not been described in detail so as not to obscure the examples/embodiments described in the specification. Those of ordinary skill in the art will understand that the examples/embodiments described and illustrated herein are non-limiting examples, and thus it can be appreciated that the specific structural and functional details disclosed herein may be representative and do not necessarily limit the scope of the embodiments.

Accordingly, even though the present disclosure has been described in detail with reference to specific examples, it will be appreciated that the various modifications and changes can be made to these examples without departing from the scope of the present disclosure as set forth in the claims. It is anticipated and intended that future developments will occur in the technologies discussed herein, and that the disclosed article and/or assembly will be incorporated into such future developments. Thus, the specification and the drawings are to be regarded as an illustrative thought instead of merely restrictive thought.

With respect to the foregoing discussion, it is noted that specific directional conventions are assumed to be known to those skilled in the art. In this context, the term "front" (or its equivalents) refers to drawer side of the storage furniture. Thus, the term "back" refers to the rear of the storage furniture, opposite to the front and typically facing a wall or other vertical support.

Additionally, the term "longitudinal" refers to the central longitudinal axis of the frame 102 that extends from the top surface 168 of the upper section 108 to the bottom surface 152 of the lower section 112. The central longitudinal axis may be considered to extend equally spaced from outermost extents of the front side 104 and the back side 106. The central longitudinal axis provides directional relationship for the terms "axially" (or its equivalents) and "radially" (or its equivalents). For example, "radially" or "radial direction" extends transversely to the longitudinal axis.

Reference throughout the specification to "examples, "in examples," "with examples," "various embodiments," "with embodiments," "in embodiments," or "an embodiment," or the like, means that a particular feature, structure, or characteristic described in connection with the example/embodiment is included in at least one embodiment. Thus, appearances of the phrases "examples, "in examples," "with examples," "in various embodiments," "with embodiments," "in embodiments," or "an embodiment," or the like, in places throughout the specification are not necessarily all referring to the same embodiment. Furthermore, the particular features, structures, or characteristics may be combined in any suitable manner in one or more examples/embodiments. Thus, the particular features, structures, or characteristics illustrated or described in connection with one embodiment/example may be combined, in whole or in part, with the features, structures, functions, and/or characteristics of one or more other embodiments/examples without limitation given that such combination is not illogical or non-functional. Moreover, many modifications may be made to adapt a particular situation or material to the teachings of the present disclosure without departing from the scope thereof.

It should be understood that references to a single element are not necessarily so limited and may include one or more of such element. Further, all numbers expressing dimensions, ratios and the like, used in the specification and claims, are to be understood to encompass tolerances and other deviations as represented by the term "about" or "approximately." Any directional references (e.g., plus, minus, upper, lower, upward, downward, left, right, leftward, rightward, top, bottom, above, below, vertical, horizontal, clockwise, and counterclockwise) are only used for identification purposes to aid the reader's understanding of the present disclosure, and do not create limitations, particularly as to the position, orientation, or use of examples/embodiments.

Joinder references (e.g., attached, coupled, connected, and the like) are to be construed broadly and may include intermediate members between a connection of elements, relative movement between elements, direct connections, indirect connections, fixed connections, movable connections, operative connections, indirect contact, and/or direct contact. As such, joinder references do not necessarily imply that two elements are directly connected/coupled and in fixed relation to each other. The use of "e.g." in the specification is to be construed broadly and is used to provide non-limiting examples of embodiments of the disclosure, and the disclosure is not limited to such examples. Uses of "and" and "or" are to be construed broadly (e.g., to be treated as "and/or"). For example and without limitation, uses of "and" do not necessarily require all elements or features listed, and uses of "or" are inclusive unless such a construction would be illogical.

All matter contained in the above description or shown in the accompanying drawings shall be interpreted as illustrative only and not limiting. Changes in detail or structure may be made without departing from the present disclosure.

All terms used in the claims are intended to be given their broadest reasonable constructions and their ordinary meanings as understood by those knowledgeable in the technologies described herein unless an explicit indication to the contrary in made herein. In particular, use of the singular articles such as "a," "the," "said," etc. should be read to recite one or more of the indicated elements unless a claim recites an explicit limitation to the contrary. Further, the use of "at least one of" is intended to be inclusive, analogous to the term and/or. As an example, the phrase "at least one of A, B and C" includes A only, B only, C only, or any combination thereof (e.g. AB, AC, BC or ABC). Additionally, use of adjectives such as first, second, etc. should be read to be interchangeable unless a claim recites an explicit limitation to the contrary.

What is claimed is:

1. A storage furniture, comprising:

a frame including a front side, a back side, an upper section with an upper front region, a lower section with a lower front region, and a central longitudinal axis equally spaced from outermost extents of the front side and the back side, the lower front region of the lower section being more forward from the central longitudinal axis of the frame than the upper front region of the upper section; and a lower drawer movable into and at least partly out of the lower section of the frame;

wherein the lower drawer includes a plurality of support structures, the plurality of support structures extending downwards from a bottom of the lower drawer for supporting the lower drawer on a floor surface when in an installed state;

wherein the lower section comprises two lower side panels;

wherein the upper section comprises two upper side panels being detachably connected to the pair of lower side panels when the frame is in an installed state; and wherein a guide track is arranged on the respective interior surface of the pair of lower side panels for receiving an upper drawer of the upper section, wherein the upper drawer has a front panel with a forwardmost surface that is inwards of a front surface of the two lower side panels relative to the central longitudinal axis when the upper drawer is in a closed position.

2. The storage furniture of claim 1, wherein the plurality of support structures comprise wheels configured to roll on the floor surface.

3. The storage furniture of claim 1, wherein the lower section has a greater front to back distance than that of the upper section.

4. The storage furniture of claim 1, wherein the upper section is detachably connected to the lower section in the installed state along a connection interface.

5. The storage furniture of claim 4, wherein the lower section includes a lower panel and the upper section includes an upper panel, the lower panel arranged between the upper drawer and the upper section relative to the central longitudinal axis, and wherein the lower panel has a front surface more forward from the central longitudinal axis than a front surface of the upper panel.

6. The storage furniture of claim 5, wherein the two lower side panels are interconnected by the lower panel, the two lower side panels each having a respective bottom surface for resting on the floor surface, and wherein the two lower side panels together with the lower panel at least partially define a compartment for the lower drawer.

7. The storage furniture of claim 6, wherein the two lower side panels each have a respective top surface and a respective interior surface, and the lower panel is arranged at a distance from the respective top surface of each of the two lower side panels relative to the central longitudinal axis.

8. The storage furniture of claim 5, wherein the two upper side panels are interconnected by the upper panel, the two upper side panels each having a respective front facing surface, and wherein the front surface of the lower panel is more forward from the central longitudinal axis than the respective front facing surface of the two upper side panels.

9. The storage furniture of claim 8, wherein the two upper side panels each have a respective bottom surface facing the lower section and a top surface;

wherein the two lower side panels are interconnected by the lower panel, the two lower side panels each having a respective bottom surface and a top surface facing the upper section; and wherein the respective bottom surface of the two upper side panels have at least one fastener and the respective top surface of the two lower side panels have at least one counter fastener, wherein the at least one fastener is structured and arranged to engage with the at least one counter fastener to secure the upper section to the lower section.

10. The storage furniture of claim 1, wherein the lower drawer is movable into and at least partly out of the lower section of the frame without exerting a downward pressure on the frame when in the installed state.

11. A storage furniture, comprising:

a frame;

at least one lower drawer movable into and at least partly out of the frame when the at least one drawer present in the frame;

the frame including an upper section and a lower section, the lower section having a greater front to back distance than that of the upper section; and the upper section including a pair of upper side panels and the lower section including a pair of lower side panels;

wherein the pair of upper side panels are detachably connected to the pair of lower side panels when the frame is in an installed state; and wherein a guide track is arranged on the respective interior surface of the pair of lower side panels for receiving an upper drawer of the upper section, wherein the upper drawer has a front panel with a forwardmost surface that is inwards of a front surface of the pair of lower side panels relative to a central longitudinal axis of the frame when the upper drawer is in a closed position.

12. The storage furniture of claim 11, wherein the pair of lower side panels each have a respective bottom surface and a respective top surface, the lower section further including a lower panel interconnecting the pair of lower side panels, the lower panel disposed at a greater distance from the respective bottom surface of the pair of lower side panels than the respective top surface of the pair of lower side panels to at least partially define a compartment underneath the lower panel relative to the upper section.

13. The storage furniture of claim 12, wherein the at least one drawer is movable into and at least partly out of the compartment in the lower section of the frame, and wherein the at least one drawer includes a plurality of wheels on a bottom of the at least one drawer that roll on a floor surface and support the at least one drawer when in the installed state.

14. The storage furniture of claim 13, wherein the at least one drawer is movable into and at least partly out of the compartment in the lower section without exerting a downward pressure on the frame.

15. The storage furniture of claim 12, wherein the pair of lower side panels each have a respective inner surface and the lower panel has a front surface, and the guide track is disposed on the inner surface between the lower panel and the respective top surface;

wherein the at least one drawer includes corresponding guide tracks that respectively mate with the guide track on the pair of lower side panels.

16. The storage furniture of claim 15, wherein the pair of upper side panels each have a respective bottom surface that ends at a greater vertical distance from the lower panel than a bottom of the at least one drawer, so that the pair of upper side panels and the pair of lower side panels each partly cover the lateral sides of the at least one drawer.

17. The storage furniture of claim 11, wherein the pair of lower side panels each have a respective top surface facing the upper section, and the pair of upper side panels each have a respective bottom surface facing the lower section, and wherein the respective top surface of the pair of lower side panels and the respective bottom surface of the pair of upper side panels have fasteners for securing the upper section to the lower section.

18. The storage furniture of claim 17, wherein the pair of lower side panels each have a respective bottom surface for resting on a floor surface and supporting the frame, and wherein the respective top surface of the pair of lower side panels defines a front to back distance that is less than that of the respective bottom surface of the pair of lower side panels.

19. The storage furniture of claim 18, wherein the pair of lower side panels each have a front facing part including a first straight and elongate portion adjoining the respective bottom surface and extending vertically relative to the floor surface, and a second portion that extends from the first portion to the respective top surface of the pair of lower side panels, and wherein the second portion is straight and angled relative to the first straight and elongate portion, or the second portion is curved from the first portion to the respective top surface.

* * * * *